US007581263B2

(12) United States Patent
Martin

(10) Patent No.: US 7,581,263 B2
(45) Date of Patent: Sep. 1, 2009

(54) TOILET FLUSH WATER OPENING DEVICE PROVIDED WITH AN ELECTROHYDRAULIC ACTUATOR

(75) Inventor: Christian Martin, St Martin l'Hortier (FR)

(73) Assignee: CELEC Conception Electronique En Abrege CELEC, Neufchatel-en-Bray (FR)

( * ) Notice: Subject to any disclaimer, the term of this patent is extended or adjusted under 35 U.S.C. 154(b) by 8 days.

(21) Appl. No.: 12/091,898

(22) PCT Filed: Oct. 24, 2006

(86) PCT No.: PCT/EP2006/067685

§ 371 (c)(1),
(2), (4) Date: Apr. 28, 2008

(87) PCT Pub. No.: WO2007/048775

PCT Pub. Date: May 3, 2007

(65) Prior Publication Data

US 2008/0229489 A1 Sep. 25, 2008

(30) Foreign Application Priority Data

Oct. 28, 2005 (FR) ..... 05 53292

(51) Int. Cl.
*E03D 1/14* (2006.01)
*E03D 5/12* (2006.01)

(52) U.S. Cl. ..... 4/407; 4/249; 4/325; 4/406

(58) Field of Classification Search ..... 4/325, 4/361, 406, 407, 408, 249, 326–328
See application file for complete search history.

(56) References Cited

U.S. PATENT DOCUMENTS

| | | | | |
|---|---|---|---|---|
| 3,987,501 | A * | 10/1976 | Anderson | 4/407 |
| 4,304,015 | A | 12/1981 | Hubatka et al. | |
| 5,228,147 | A * | 7/1993 | Fominaya Agullo | 4/407 |

FOREIGN PATENT DOCUMENTS

| | | |
|---|---|---|
| AT | 324960 | 9/1975 |
| DE | 10002308 | 8/2001 |
| DE | 10253890 | 6/2004 |
| FR | 2642778 | 8/1990 |

OTHER PUBLICATIONS

International Search Report for PCT/EP2006/067685.

* cited by examiner

*Primary Examiner*—Tuan N Nguyen
(74) *Attorney, Agent, or Firm*—Young & Thompson

(57) ABSTRACT

A toilet flush opening device (10) includes a water cistern (12) that includes a lower discharge aperture (14) and a vertical moveable discharging open/close element (16) for this aperture (14), which is able to occupy a closed lower position to keep the water in the cistern (12) or an open upper position to discharge the water into a toilet bowl. The device is characterized in that the open/close element (16) can be urged from its lower position to its upper position by an electrohydraulic actuator (18) which includes a controlled solenoid valve (20), and an expandable hydraulic device (22) that can be supplied with water at pressure by the solenoid valve (20) to urge the open/close element (16) from its closed lower position to its open upper position.

13 Claims, 3 Drawing Sheets

FIG.1
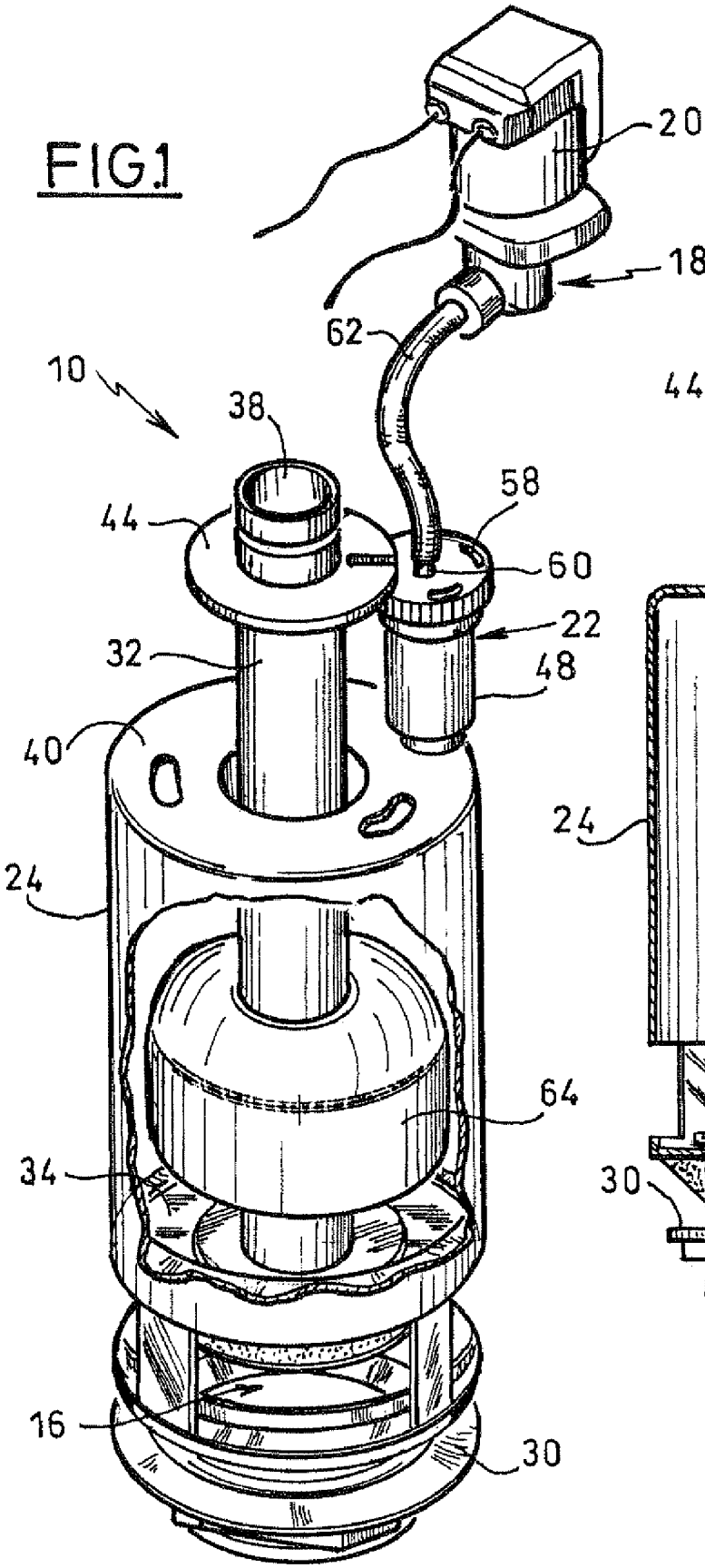
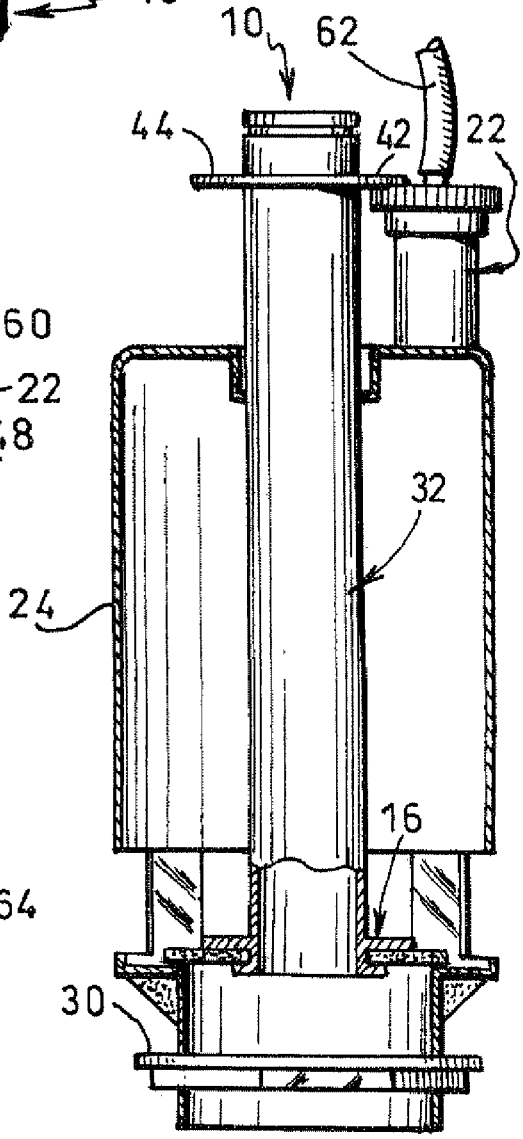
FIG.4

TOILET FLUSH WATER OPENING DEVICE PROVIDED WITH AN ELECTROHYDRAULIC ACTUATOR

The invention relates to a toilet flush opening device of the type that comprises a water cistern supplied by a valve connected to a water supply system, and that can be opened to allow the cistern to be filled if the water level drops below a predetermined lower limit, and of the type that comprises a lower discharge aperture and a vertical moveable discharging open/close element for this aperture, which is able to occupy a closed lower position to keep the water in the cistern or an open upper position to discharge the water into a toilet bowl.

BACKGROUND OF THE INVENTION

Numerous examples of flush opening devices of this kind are known.

Most of them are devices in which the discharging open/close element is operable mechanically by way of a member moved directly by the user.

This configuration, when installed in public toilets frequented by large numbers of users, leads to many user problems. Specifically, users may forget to operate the actuating member of the discharging open/close element and the state of cleanliness of the toilets can decline rapidly.

To overcome this problem, toilet flush opening devices have been disclosed in which the discharging open/close element can be moved automatically by an electrical device.

This configuration consumes a lot of energy because in order to move the discharging open/close element it must have a high-power electrical supply such as a mains supply.

To solve this problem, toilet flush opening devices have been disclosed in which the discharging open/close element can be operated by a submerged float that can be released into a position of actuating the open/close element by an electrical device.

This configuration is satisfactory but the problem with it is that while the flush is not being used the electrical device is under permanent stress from the submerged float.

SUMMARY OF THE INVENTION

To solve this problem, the invention provides a toilet flush opening device of the type described above, in which the open/close element can be moved by an electrohydraulic actuator.

To this end, the invention provides a toilet flush opening device of the type described above, characterized in that the open/close element can be moved from its lower position to its upper position by an electrohydraulic actuator which comprises a controlled solenoid valve able to occupy an inactive position or an active position, in which active position it delivers water at pressure, and an expandable hydraulic device supplied by the solenoid valve and connected mechanically to the open/close element, which is moveable between:

- a retracted position in which it is not supplied by the solenoid valve and does not move the open/close element, and
- an extended position in which it is supplied with water at pressure by the solenoid valve and tends to move the open/close element from its closed lower position to its open upper position.

In accordance with other features of the invention:

- the toilet flush opening device comprises, fixed inside the cistern, an essentially tubular and vertical casing whose lower end comprises an open/close element seat coinciding with the lower discharge aperture of the cistern and inside which there is mounted a sliding actuating rod whose lower end comprises an open/close element seat seal and whose upper end, which projects from the casing, can be actuated by the expandable hydraulic device to actuate the open/close element seat,
- the expandable hydraulic device is mounted on an upper face of the tubular casing and it comprises at least one moveable upper actuating face that is able, when the expandable hydraulic device is in the extended position, to apply force to a shoulder element mounted on the upper end of the actuating rod,
- the expandable hydraulic device comprises:
  - a vertical guide pin mounted on the upper face of the tubular casing,
  - a tubular cylindrical body mounted so as to slide on the pin,
  - a cap, which closes the upper end of the cylindrical body and whose upper face is the moveable upper actuating face, and
  - housed in the tubular cylindrical body between the cap and the upper end of the pin, an inflatable element that can be supplied with water at pressure from the solenoid valve via a channel which extends through the cap so as to inflate and push against the upper end of the pin in such a way as to lift the cap and apply force to the shoulder element of the actuating rod,
- the inflatable element consists of a membrane attached to the underside of the cap and defining an inflatable chamber that can be supplied by the channel passing through the cap with water at pressure from the solenoid valve and that is able, in the absence of water at pressure, to drain into the cistern via at least one hole in the cap by the forces of gravity acting on the actuating rod, on the tubular cylindrical body and on the cap of the expandable hydraulic device,
- the cap has on its upper face a connecting adapter inside which the channel is formed and which is connected to the solenoid value via a flexible tube,
- the shoulder element of the actuating rod is a split washer which fits into a groove formed at the end of the actuating rod,
- the casing houses a submerged assistance float that is attached to the actuating rod and that has buoyancy features such that:
  - in the retracted position of the electrohydraulic actuator linked with the closed lower position of the open/close element, the buoyancy of the assistance float does not overcome the resultant of the forces of gravity acting on the actuating rod and the open/close element,
  - in the extended position of the electrohydraulic actuator associated with the open upper position of the open/close element, the buoyancy of the assistance float is added to the actuating force of the electrohydraulic actuator to assist the rise of the actuating rod carrying the seal of the open/close element.

The invention also relates to a method of controlling a solenoid valve of an electrohydraulic actuator for a toilet flush opening device.

In a first embodiment of this method, it comprises at least one step linked to the complete draining of the cistern during which the solenoid valve is activated for a first period linked to the complete draining of the cistern.

In a second embodiment of this method, it also comprises at least one step linked to a partial draining of the cistern during which the solenoid valve is activated for a second predetermined period corresponding to a part of the first period linked to the complete draining of the cistern.

In a third embodiment of this method, it comprises a step linked to the complete draining of the cistern during which the solenoid valve is activated for a reduced period so that the expandable hydraulic device provides a pulse to the actuating rod such as to drain the cistern completely, and the submerged float assists the rise of the actuating rod and that of the seal of the open/close element.

BRIEF DESCRIPTION OF THE DRAWINGS

Other features and advantages will become apparent in the course of reading the following detailed description, for an understanding of which the reader should refer to the attached drawings, in which:

FIG. 1 is a general perspective view of a toilet flush opening device according to the invention;

FIG. 4 is a general view in axial section through a toilet flush opening device in a variant shown in the extended position of the expandable hydraulic device.

DETAILED DESCRIPTION OF THE PREFFERED EMBODIMENTS

Figure 2:
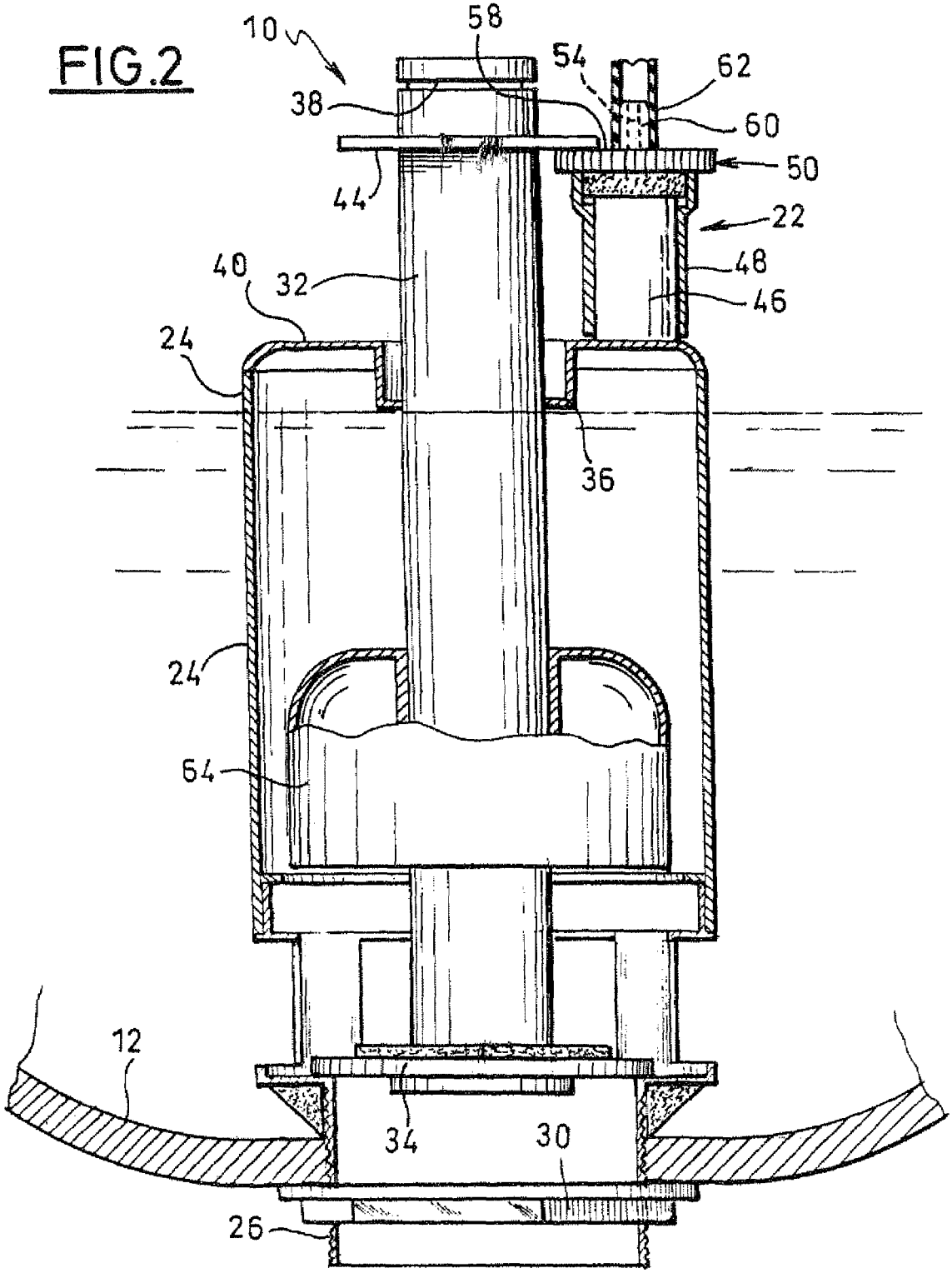
FIG. 2 is a general view in axial section through the toilet flush opening device of FIG. 1, shown with the expandable hydraulic device retracted.

In the following description, identical references denote identical parts or parts having similar functions.

The figures show the whole of a toilet flush opening device 10 constructed in accordance with the invention.

As in the prior art, the device 10 comprises a water cistern 12 that is supplied by a valve (not shown) connected to a water supply system, and that can be opened to allow the cistern 12 to be filled if the water level drops below a predetermined lower limit. The cistern 12 comprises a lower discharge aperture 14 and a vertical moveable discharging open/close element 16 for this aperture 14, which is able to occupy a closed lower position, shown in FIG. 2, to keep the water in the cistern 12 or an open upper position, shown in FIGS. 3 and 4, to discharge the water into a toilet bowl (not shown).

Conventionally, the discharging open/close element 16 can be actuated mechanically by way of a component moved directly by the user.

Effective as this construction may be when installed in a private dwelling or in infrequently used toilets, it is not suitable for public toilets used by large numbers of people.

To solve this problem, there exists in the prior art a toilet flush opening device 10 in which the open/close element 16 can be moved in an automated manner by an electric actuator.

This configuration consumes a lot of energy because in order to move the discharging open/close element 16 it needs a high-power electrical supply such as a mains supply.

The invention provides a toilet flush opening device 10 in which the open/close element 16 can be moved in an automated manner by an electric actuator running off a low-power electricity supply, meaning that said device can be used in toilets installed in places that do not have a high-power electricity supply.

The invention is thus of particular application to public toilets remote from a mains electricity supply—as for example, without limiting the invention, beach toilets or portable toilets erected temporarily at public gatherings.

To this end, as shown in FIG. 1, the invention provides a toilet flush opening device 10 of the type described earlier, characterized in that the open/close element 16 can be moved from its lower position to its upper position by an electrohydraulic actuator 18.

As shown in FIG. 1, this electrohydraulic actuator 18 comprises a controlled solenoid valve 20 able to occupy an inactive position (not shown) or an active position (not shown), in which active position it delivers water at pressure, and an expandable hydraulic device 22 which is supplied by the solenoid valve 18 and is connected mechanically to the open/close element 16.

Figure 3:
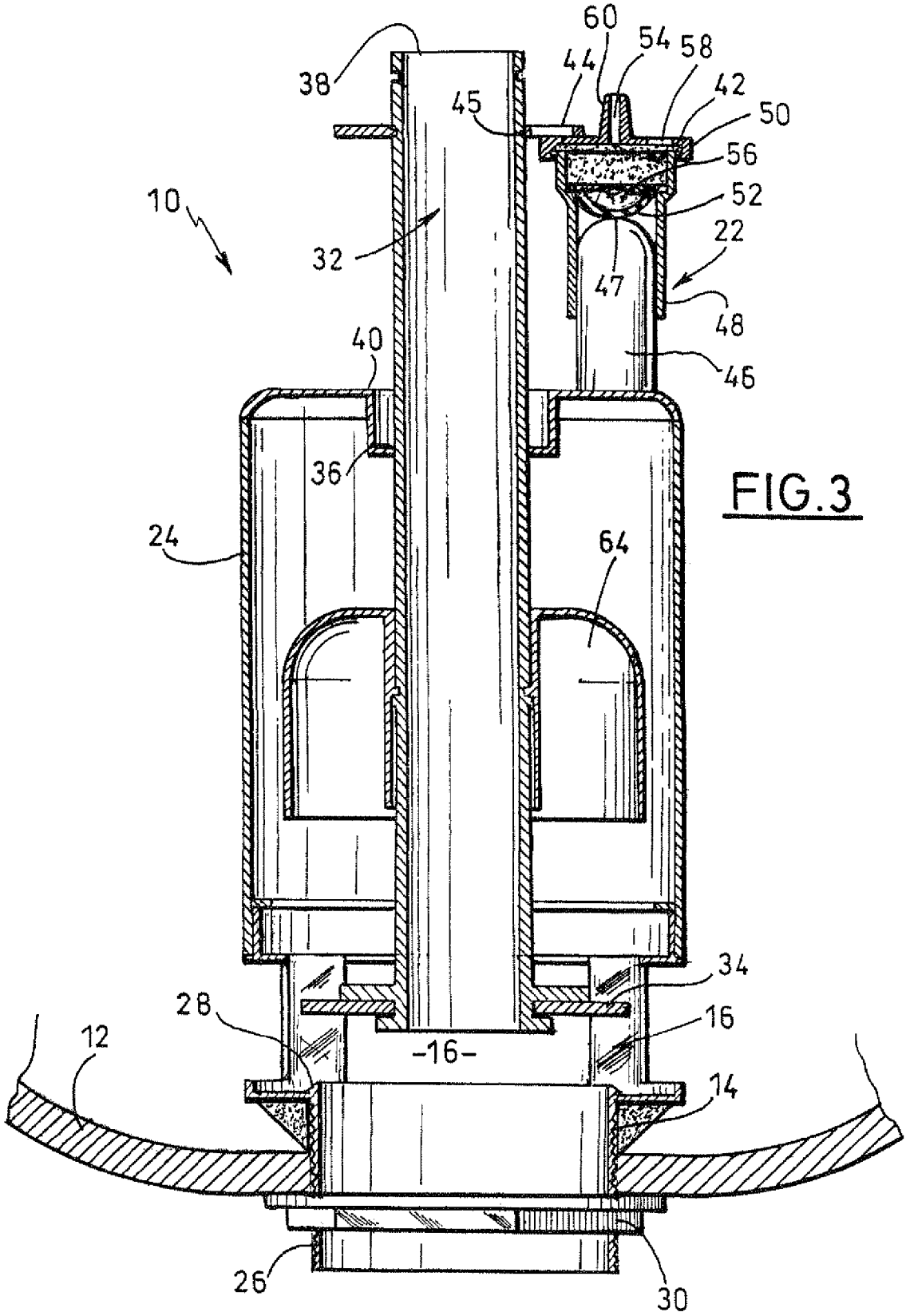
FIG. 3 is a general view in axial section through the toilet flush opening device of FIG. 1, shown with the expandable hydraulic device extended.

More particularly, as illustrated in FIGS. 2 and 3, this expandable hydraulic device 22 is moveable between:

- a retracted position, shown in FIG. 2, in which it is not supplied by the solenoid valve 20 described above with reference to FIG. 1, and does not move the open/close element 16, and
- an extended position, shown in FIG. 3, in which the expandable hydraulic device 22 is supplied with water at pressure by the solenoid valve 20 described above with reference to FIG. 1, and tends to move the open/close element 16 from its closed lower position to its open upper position.

More particularly, as shown in FIGS. 1-4, the flush opening device 10 according to the invention comprises, fixed inside the cistern 12, an essentially tubular and vertical casing 24.

For this purpose, a threaded tubular lower end 26 of the casing 24 extends through the discharge aperture 14 of the cistern 12 and is fixed relative to the cistern 12 by an opposing nut 30 to immobilize the casing 24 inside the cistern 12.

The lower end 26 of the casing 24 comprises an open/close element seat 28 that coincides with the lower discharge aperture 14 of the cistern 12.

Mounted inside the casing 24, in an upper bearing 36, is a sliding actuating rod 32 whose lower end comprises a seal 34 for the open/close element 16 seat 28 and whose upper end 38 projects from the casing 24. This upper end 38 can be actuated by the expandable hydraulic device 22 to actuate the seal 34 of the open/close element 16.

Any form of mechanical connection between the expandable hydraulic device 22 and the actuating rod 32 may be suitable for successful implementation of the invention.

However, in the preferred embodiment of the invention, the expandable hydraulic device 22 is mounted on an upper face 40 of the tubular casing 24 and comprises at least one moveable upper actuating face 42 that is able, when the expandable hydraulic device shown in FIG. 3 is in the extended position, to apply force to a shoulder element 44 mounted on the upper end 38 of the actuating rod 32.

This shoulder element may for example be a split washer 44 that fits into a groove 45 formed at the end 38 of the actuating rod 32.

The expandable hydraulic device 22 may be implemented in any way, provided it is capable of lifting the shoulder element 44 of the actuating rod 32 through a sufficient stroke to open the open/close element 16.

As shown in the figures, the expandable hydraulic device 22 preferably comprises:

- a vertical guide pin 46 which is mounted on the upper face 40 of the tubular casing 24 and has a hemispherical upper end 47,
- a tubular cylindrical body 48 mounted so as to slide on the pin 46, a cap 50, which closes the upper end of the cylindrical body 48 and whose upper face is the moveable upper actuating face 42, and housed in the tubular cylindrical body 48 between the cap 50 and the upper end 47 of the pin 46, an inflatable element 52 that can be supplied with water at pressure from the solenoid valve 20 via a channel 54 which extends through the cap 50 so as to inflate and push against the upper end 47 of the pin 46 in such a way as to lift the cap 50 and apply force to the washer 44 of the actuating rod 32.

The inflatable element preferably consists of a membrane 52 that is attached to the underside of the cap 50, or that is clamped between the cap 50 and the body 48, and that defines an inflatable chamber 56 that can be supplied via the channel 54 passing through the cap 50 with water at pressure from the solenoid valve 20.

In the absence of water at pressure, this chamber 56 is able to drain spontaneously into the cistern 12 through at least one hole 58 in the cap, by the forces of gravity acting on the actuating rod 32, on the tubular cylindrical body 48 and on the cap 50 of the expandable hydraulic device. The hole 58 is so designed that the flow rate of the leak which it permits does not prevent the chamber 56 from being inflated when pressure is established in it.

To supply the chamber 56, the cap 50 advantageously has on its upper face 42 a connecting adapter 60 inside which the channel 54 is formed and which is connected to the solenoid value 20 via a flexible tube 62, as shown in FIG. 1.

In the preferred embodiment of the invention, which is shown in FIGS. 1-3, the casing 24 houses a submerged assistance float 64 that is attached to the actuating rod 32 and that has buoyancy features such that:

in the retracted position of the electrohydraulic actuator 18 associated with the closed lower position of the open/close element 16, as shown in FIG. 2, the buoyancy of the assistance float 64 does not overcome the resultant of the forces of gravity acting on the actuating rod 32 and the open/close element 16, in the extended position of the electrohydraulic actuator 18 associated with the open upper position of the open/close element 16, as shown in FIG. 3, the buoyancy of the assistance float 64 is added to the actuating force of the electrohydraulic actuator 18 and more particularly of the expandable hydraulic device 22, to assist the rise of the actuating rod 32 carrying the seal 34 of the open/close element 16.

In this configuration, which corresponds to a first embodiment of the invention, the solenoid valve 20 of the electrohydraulic actuator can be controlled by a method comprising a step linked to the complete draining of the cistern 12 during which the solenoid valve 20 is activated for a reduced period so that the expandable hydraulic device 22 provides a pulse to the actuating rod 32 such as to drain the cistern 12 completely, the submerged float 64 assists the rise of the actuating rod 32 and that of the seal 34 of the open/close element 16 and the open/close element 16 is only closed again when the water level in the cistern 12 has dropped sufficiently for the float 64 no longer to oppose the closing of the open/close element 16.

In a second embodiment, as a variant of the invention more particularly shown in FIG. 4, the actuating rod 32 need not have an assistance float 64, and in this case the actuating rod 32 is lifted purely by the force applied by the expandable device 22 on the washer 44.

In this configuration the solenoid valve 20 of the electrohydraulic actuator may be controlled by an method comprising a step linked to the complete draining of the cistern 12, during which the solenoid valve 20 is activated for a first predetermined period linked to the complete draining of the cistern 12. This period can be determined very easily from the volume of water contained in the cistern and from the diameter of the aperture 14.

Advantageously, in this second embodiment of the invention, the solenoid valve 20 of the electrohydraulic actuator may be controlled by a method that also comprises at least one step linked to a partial draining of the cistern 12 during which the solenoid valve 20 is activated for a second predetermined period corresponding to a part of the first period linked to the complete draining of the cistern 12.

This second period may for example be a fraction of the first duration and can be used to drain a fraction of the volume of the cistern, depending on the type of matter to be flushed from the toilet.

The invention thus provides a compact and innovative toilet flush opening device that can be powered by a low-power electricity supply such as that delivered by a low-voltage cell or battery.

The invention claimed is:

1. A toilet flush opening device (10), comprising:

a water cistern (12);

a valve, supplying the water cistern, connected to a water supply system, openable to allow the cistern (12) to be filled with water if a water level in the cistern (12) drops below a predetermined lower limit;

a lower discharge aperture (14) at a bottom of the cistern (12);

a vertical moveable discharging open/close element (16) over the aperture (14), configured to occupy i) a closed lower position to keep the water in the cistern (12), and ii) an open upper position to discharge the water from the cistern (12) into a toilet bowl, the open/close element (16) comprised of a tubular vertical casing (24), the tubular vertical casing (24) having an upper face (40) and a lower end (26), the lower end (26) comprised of an open/close element seat (28) coinciding with the lower discharge aperture (14);

an electrohydraulic actuator (18) comprised of a controlled solenoid valve (20) and an expandable hydraulic device (22), the expandable hydraulic device (22) supplied by the solenoid valve (20) and connected mechanically to the open/close element (16); and a sliding actuating rod (32) mounted inside the tubular vertical casing (24) and having a lower first end and an upper second end, the lower first end comprising an open/close element seat seal (34), and the upper second end, having a horizontal shoulder element (44) mounted immediately proximate to an uppermost end of the upper second end, projecting from the tubular vertical casing (24), the upper second end configured to be actuated by the expandable hydraulic device (22) to actuate the open/close element seal (34), wherein the solenoid valve (20) is configured to occupy an inactive position and an active position, the solenoid valve (20) configured to deliver water at pressure when the active position is occupied, wherein the hydraulic device (22) is moveable between a retracted position and an extended position, the expandable hydraulic device (22) i) not supplied by the solenoid valve (20) and not moving the open/close element (16) when the hydraulic device (22) is in the retracted position, and ii) the expandable hydraulic device (22) supplied with water at pressure by the solenoid valve (20) and tending to move the open/close element (16) from the closed lower position to the open upper position when the hydraulic device (22) is in the extended position, and wherein the expandable hydraulic device (22) is mounted on the upper face (40) of the tubular casing (24), and comprises at least one moveable upper actuating face (42), the at least one moveable upper actuating face (42) configured to apply an actuating force to the shoulder element (44) of the upper second end (38) of the actuating rod (32) when the expandable hydraulic device (22) is in the extended position.

2. The toilet flush opening device (10) as claimed in claim 1, wherein the expandable hydraulic device (22) further comprises a vertical guide pin (46) mounted on the upper face (40) of the tubular casing (24), a tubular cylindrical body (48) mounted so as to slide on the pin (46), a cap (50) configured to close an upper end of the cylindrical body (48) and having an upper cap face defining the moveable upper actuating face (42), and an inflatable element (52) housed in the tubular cylindrical body (48) between the cap (50) and the upper end (47) of the pin (46), the inflatable element (52) configured to be supplied with water at pressure from the solenoid valve via a channel (54), the channel (54) extending through the cap (50) 50 as to inflate and push against the upper end (47) of the pin (46) to lift the cap (50) and apply force to the shoulder element (44) of the actuating rod (32).

3. The toilet flush opening device (10) as claimed in claim 2, wherein the inflatable element consists of a membrane (52) attached to an underside of the cap (50) and defining an inflatable chamber (56) configured to be supplied by the channel (54) with water at pressure from the solenoid valve (20), and further configured, in the absence of water at pressure, to drain into the cistern (12) via at least one hole (58) in the cap (50) by means of gravity acting on each of the actuating rod (32), the tubular cylindrical body (48), and the cap (50).

4. The toilet flush opening device (10) as claimed in claim 3, wherein a connecting adapter (60) is provided on the upper cap face (42), wherein the channel (54) is formed inside the connecting adapter (60), and wherein the channel (54) is connected to the solenoid value (22) via a flexible hose (62).

5. The toilet flush opening device (10) as claimed in claim 1, wherein the shoulder element (44) of the actuating rod (32) is a split washer which fits into a groove (45) formed at the upper second end (38) of the actuating rod (32).

6. The toilet flush opening device (10) as claimed in claim 1, wherein the casing (24) houses a submerged assistance float (64), the assistance float (64) being attached to the actuating rod (32) and having buoyancy features such that i) in the retracted position of the electrohydraulic actuator (18) associated with the closed lower position of the open/close element (16), a buoyancy of the assistance float (64) does not overcome a resultant of gravity acting on the actuating rod (32) and the open/close element (16), and ii) in the extended position of the electrohydraulic actuator (18) associated with the open upper position of the open/close element, the buoyancy of the assistance float (64) is added to the actuating force of the electrohydraulic actuator (18) to assist a rising of the actuating rod (32) carrying the seal (34) of the open/close element (16).

7. A method of controlling a solenoid valve (20) of an electrohydraulic actuator (18) for a toilet flush opening device (10) as claimed in claim 1, comprising the step of:

completely draining the cistern (12), during which the solenoid valve (20) is activated for a first period linked to the complete draining of the cistern (12).

8. The method of controlling a solenoid valve (20) of an electrohydraulic actuator (18) for a toilet flush opening device (10) as claimed in claim 7, further comprising the step of:

partially draining the cistern (12), during which the solenoid valve (20) is activated for a second predetermined period corresponding to a part of the first period linked to the complete draining of the cistern (12).

9. A method of controlling a solenoid valve (20) of an electrohydraulic actuator (18) for a toilet flush opening device (10) as claimed in claim 1, comprising:

completely draining the cistern (12), during which i) the solenoid valve (20) is activated for a reduced period so that the expandable hydraulic device (22) provides a pulse to the actuating rod (32) such as to drain the cistern (12) completely, and ii) the submerged float (64) assists a rising of the actuating rod (32) and a rising of the seal (34) of the open/close element (16).

10. The toilet flush opening device (10) as claimed in claim 2, wherein the shoulder element (44) of the actuating rod (32) is a split washer which fits into a groove (45) formed at the upper second end (38) of the actuating rod (32).

11. The toilet flush opening device (10) as claimed in claim 3, wherein the shoulder element (44) of the actuating rod (32) is a split washer which fits into a groove (45) formed at the upper second end (38) of the actuating rod (32).

12. The toilet flush opening device (10) as claimed in claim 4, wherein the shoulder element (44) of the actuating rod (32) is a split washer which fits into a groove (45) formed at the upper second end (38) of the actuating rod (32).

13. The toilet flush opening device (10) as claimed in claim 2, wherein the casing (24) houses a submerged assistance float (64), the assistance float (64) being attached to the actuating rod (32) and having buoyancy features such that i) in the retracted position of the electrohydraulic actuator (18) associated with the closed lower position of the open/close element (16), a buoyancy of the assistance float (64) does not overcome a resultant of gravity acting on the actuating rod (32) and the open/close element (16), and ii) in the extended position of the electrohydraulic actuator (18) associated with the open upper position of the open/close element, the buoyancy of the assistance float (64) is added to the actuating force of the electrohydraulic actuator (18) to assist a rising of the actuating rod (32) carrying the seal (34) of the open/close element (16).

* * * * *